US007468710B2

(12) United States Patent
Nakaoka

(10) Patent No.: US 7,468,710 B2
(45) Date of Patent: Dec. 23, 2008

(54) LIGHT EMITTING DISPLAY DEVICE

(75) Inventor: Yasunari Nakaoka, Kyoto (JP)

(73) Assignee: Rohm Co., Ltd., Kyoto-shi (JP)

( * ) Notice: Subject to any disclaimer, the term of this patent is extended or adjusted under 35 U.S.C. 154(b) by 638 days.

(21) Appl. No.: 10/858,210

(22) Filed: Jun. 2, 2004

(65) Prior Publication Data

US 2004/0246203 A1 Dec. 9, 2004

(30) Foreign Application Priority Data

Jun. 9, 2003 (JP) ..... 2003-164131
Jun. 9, 2003 (JP) ..... 2003-164132

(51) Int. Cl.
*G09G 3/00* (2006.01)
*G09G 3/04* (2006.01)
*G08B 5/00* (2006.01)
*F21V 21/30* (2006.01)

(52) U.S. Cl. ..... 345/32; 345/33; 345/82; 345/102; 340/815.42; 340/815.43; 340/815.44; 340/815.45; 362/603; 362/615; 362/623

(58) Field of Classification Search ..... 345/33–39, 345/44, 46, 48, 82, 83, 102, 32; 362/555, 362/558, 560, 561, 600, 603, 608, 613, 615, 362/623, 33–39, 44, 46, 48, 82, 83, 102; 340/815.42–815.45; 40/446–452, 546
See application file for complete search history.

(56) References Cited

U.S. PATENT DOCUMENTS 6,144,424 A * 11/2000 Okuda et al. ..... 349/65
6,539,656 B2 * 4/2003 Maas et al. ..... 40/546
6,592,234 B2 * 7/2003 Epstein et al. ..... 362/603
6,712,481 B2 * 3/2004 Parker et al. ..... 362/619

FOREIGN PATENT DOCUMENTS

| | | |
|---|---|---|
| JP | 37979 | 12/1925 |
| JP | 48-88896 | 11/1973 |
| JP | 53-133595 | 3/1977 |
| JP | 56-5112 | 2/1981 |
| JP | 61-226682 | 10/1986 |
| JP | 2-21687 | 2/1990 |
| JP | 03-107992 | 5/1991 |
| JP | 04-198977 | 7/1992 |
| JP | 06-37437 | 5/1994 |
| JP | 7-19775 | 4/1995 |
| JP | 08-153405 | 6/1996 |
| JP | 2001-343917 | 12/2001 |
| JP | 2002-182589 | 6/2002 |

* cited by examiner

*Primary Examiner*—Henry N Tran
(74) *Attorney, Agent, or Firm*—Rabin & Berdo, PC

(57) ABSTRACT

A light guiding plate is provided on the obverse side of a display for displaying a display image while varying the display image. Unevenness is formed at a predetermined position at a reverse surface of the light guiding plate. A light emitting element is disposed at the side surface of the light guiding plate in such a manner as to introduce the light to the light guiding plate. Alternatively, an uneven portion in conformity with a pattern of a desired display image may be formed at a reverse surface of the light guiding plate, and a light emitting element is disposed at the side surface of the light guiding plate in such a manner as to introduce the light to the light guiding plate.

17 Claims, 5 Drawing Sheets

LIGHT EMITTING DISPLAY DEVICE

FIELD OF THE INVENTION

The present invention relates to a light emitting display device for use in, for example, a play machine such as a pachinko machine or a slot machine, which display numerals, letters, characters and the like consisted by 7 segments or a dot matrix structure by using a light emitting element such as an LED or a light emitting display device capable of displaying a predetermined image such as a guide display or a simple advertisement in a public building by lightning. More particularly, the present invention relates to a gorgeous light emitting display device suitable for displaying numerals, letters and the like in a desired various background color, or a light emitting display device which is easy to appeal a display image in a mixed color with a very simple configuration.

BACKGROUND OF THE INVENTION

A conventional light emitting display of a 7-segment structure has a configuration shown in FIG. 6A, which is a perspective explanatory view, and in FIG. 6B, which is a cross-sectional explanatory view, taken along a line B-B of FIG. 6A. Specifically, a light guide 13*a* constituting 7 segments is formed at a reflecting case 13. A light emitting diode (hereinafter, abbreviated as "an LED") chip 12 is die-bonded to a lead 11 with respect to each of the segments. The LED chip 12 is wire-bonded via a gold wire 121 or the like, and then, a translucent or transparent resin (resin passing through the light) 14 is filled into the light guide 13*a*. The LED has an anode and a cathode. Although two leads are required for each of the segments, the lead of either one of the anode and the cathode can be commonly used by the segments. Eight to ten leads form a numeral of one digit (inclusive of leads for displaying a decimal point), and the plurality of leads 11 are disposed along two long sides in a vertical direction (that is, both of lateral sides in a displaying direction) or on both sides in a vertical direction.

The inside of the above-described light guide 13*a* needs to be a light reflective color based on a white color in order to emit light emitted from the LED 12 as brightly as possible at the segment, and therefore, the reflecting case is normally resin-molded with a white plastic. In order to easily recognize a display color of each of the segments, a surface of the case B of display side is coated with a dark color such as black. This black coating is applied by screen printing with an black ink, followed by drying (see, for example, Japanese Published Unexamined Application No. 2002-182589).

In the meantime, an illumination signboard has been known as a device for displaying a predetermined image or letter such as advertisement or a guide display plate at a station or the like, unlike an LED dot matrix display device or a liquid crystal display device in which a display image are changed at any time. In the illumination signboard, a light source such as a fluorescent tube 51 serving as a backlight is housed inside of a reflecting case 52, and further, a display panel 54, on which an image is formed, is disposed at the surface of the backlight via a light diffusing plate 53, so that an image formed on a display film is lighted up, as shown in, for example, FIG. 7.

With the above-described configuration in which the fluorescent tube is used as the backlight, a uniform display image cannot be formed due to the appearance of the fluorescent tube since it is too bright near the fluorescent tube 51 while it is too dark apart from the fluorescent tube 51 unless a distance between the fluorescent tube 51 and the display panel 54 is set large, thereby raising a problem of a large size of the device with a great depth (see, for example, Japanese Published Unexamined Application No. 8-153405).

In order to solve the above-described problem, as shown in FIG. 8, there has been known a configuration in which light is guided from a side surface of a light guiding plate 61 by using a linear light source 62 having a fluorescent tube or light emitting diodes (i.e., LEDs) which are arranged linear like, or a dotted-like light source, and further, a display panel 64 on which an image is formed, or a liquid crystal panel is disposed at the upper surface. In this configuration, a plane-like light source for uniformly radiating light via a light diffusing plate 63 disposed at the surface of the light source is used as a backlight, so as to display the image on the display panel or the liquid crystal panel (see, for example, Japanese Published Unexamined Application No. 8-153405). In this case, a light reflecting film may be provided at the reverse or side surface of the light guiding plate, or a reflecting film pattern different in size may be formed at the reverse of the light guiding plate in order to make luminance at the surface uniform.

As described above, in the light emitting display device for the numeral or the like, the reflecting case is formed with a white plastic, and further, its surface of display side is coated with a dark color such as black. However, although in case that the device is used for a fee display at a normal vending machine or a time or a guide displayed on a destination list at a station, only the display of numerals or letters consisting of 7 segments in red in a dark color background is sufficient, in case that gorgeousness is required for a play machine such as a pachinko machine or a slot machine, it raises a problem of poor attraction in a simple display in the dark color background.

Moreover, in changing the color of a background in the conventional 7-segment display, a color to be applied to the surface of the reflecting case can be replaced with a showy color, but there are few variations by only changing the color of the reflecting case since the color is the same at all times. In view of this, in order to change the color of the background, it is necessary to dispose LEDs for the color of the background inside of the case partitioning the segments. However, since the case is molded with the resin, as described above, some thickness is required for fabricating the case without any deformation of the case (in particular, any degradation of the flatness of the surface), and further, a clearance for relieving a stress is also required, thereby making it impossible to additionally dispose the LEDs from the viewpoint of a space.

In addition, it may be constructed that, for example, LEDs are disposed on a portion corresponding to the display of the 7 segments and other portions on a substrate, and only the portion corresponding to the display of the 7 segments is partitioned with a cover for allowing all of the segments to emit light, respectively; and the display image and the background are lighted in different colors. However, it is necessary to dispose LEDs in divided non-displays, respectively. In particular, LEDs of red (R), green (G) and blue (B) are required for each of the non-displays in order to display the background in full colors. This markedly increases the number of LEDs, thereby leading to an increase in cost. Moreover, if the display image and the background color are lighted at the same luminance, it is difficult to identify the display image, so it arises an attendant problem that a drive circuit needs to be independently disposed.

On the other hand, as described above, in the case where a display image, which is not changed, is displayed by lighting up or the like, a clear display image is lighted up, to achieve a display of a good appearance by directly irradiating the display panel having an image formed thereon from the reverse thereof by a light source or irradiating the display panel by the backlight which is a uniform plane-like light source using a light guiding plate. However, in the case of the direct irradiation, the distance between the light source and the display panel must be enlarged, thereby increasing a size. Further, in the case of using the light guiding plate there has arisen a problem of an increase in cost. Additionally, the image is not directly displayed with the light emitted from the light source in any of the methods, but the display panel is lighted up. Therefore, the light emitted from the light source is indirectly used in much vain with much consumption of electric power, thereby raising a problem of an increase in cost.

Moreover, in the case of, for example, a simple guide display such as "Emergency" in a building or "Entrance" or "Exit" inside of a public building or a simple display advertisement plate, it is desirable to achieve as attractive a display as possible at a reduced cost in thin shape with low consumption of electric power.

SUMMARY OF THE INVENTION

The present invention has been accomplished to solve the above-described problems experienced in the prior art. Therefore, an object of the present invention is to provide an inexpensive light emitting display device capable of varying a color of a background of a display using 7 segments or a display for a simple letter or character, so as to achieve gorgeous displaying in a play machine or the like.

Another object of the present invention is to provide a small-sized and thin light emitting display device with little consumption of electric power, capable of displaying a simple letter or figure by direct light emission.

The present inventor has found that when light is guided (introduced) into a light guiding plate from a side surface of the light guiding plate by an LED after unevenness is formed at the reverse surface of the light guiding plate by hairlining or graining, the light guided is turbulently reflected by the unevenness, so that only the uneven portion looks like emitting the light. In the case where light is emitted from another display in a direction perpendicular to the light guiding plate, the light is recognized to be transmitted through the light guiding plate as it is. So, an image displayed under the light guiding plate and an image displayed by the unevenness formed at the light guiding plate can be recognized together. If the unevenness is formed at substantially the entire reverse surface, the entire reverse is lighted as the color of the background of the display disposed at the reverse side.

Moreover, the present inventor has found that when the two or more light guiding plates, each of which has unevenness formed in conformity with an image of a letter or a figure are provided repeatedly, and then, the light is made to enter by a light emitting element from the side surface of the light guiding plate, the images formed on the light guiding plates can be displayed in superimposition. Incidentally, in the case where the two or more light guiding plates are provided, the light emitting elements need to be shielded in such a manner as to prevent any crosstalk of the light of the respective light emitting elements between the light guiding plates, and a clearance needs to be formed between the light guiding plates. As a result, it is possible to display a desired image in a desired color by lighting up while varying the light emitting color of the introduced light.

A light emitting display device according to the present invention comprises: a display for displaying a display image while varying the display image; a light guiding plate provided on an obverse side of the display and having unevenness at a predetermined position at a reverse surface thereof; and a light emitting element disposed at a side surface of the light guiding plate in such a manner as to introduce a light into the light guiding plate.

Here, the display image signifies an image such as a numeral, a letter, a character or a figure whose display state can be varied, or an image such as a letter or a figure which can be used for a signboard for guidance or advertisement. Furthermore, the unevenness connotes a state in which linear grooves (i.e., hairlines) or grains are formed.

With the above-described structure, the display image on the display is displayed as it is through the light guiding plate. Although the light incident into the light guiding plate from the light emitting element disposed at the side surface of the light guiding plate is repeated to be fully reflected inside of the light guiding plate, the light incident into the uneven portion is turbulently reflected on the uneven portion, and further, a part of the light is irradiated from the surface of the light guiding plate. Consequently, since the uneven portion of the light guiding plate lights according to the color of the light introduced from the side surface of the light guiding plate, the background of the display image can be displayed in the color of the light introduced from the side surface if the unevenness is formed over the entire portion corresponding to the surroundings of the display image.

Specifically, the light emitting display device can be configured such that the display is a display using 7 segments having light emitting diodes (LEDs), and the unevenness provided at a reverse surface of the light guiding plate is formed over the entire surface or a portion other than the display portions of the 7 segments. Since the luminance is great with the 7 segments using the light emitting diode, the unevenness to be provided on the light guiding plate may be formed over the entire light guiding plate, so that the 7-segment display is carried out without any cancellation or discoloration of the display in a predetermined background, even if the background light is emitted from the entire surface. Moreover, with the structure in which the unevenness is formed only on the portion other than the image of the 7-segment display, the color displayed by the 7-segment display cannot be mixed with the background color of the light guiding plate, thereby achieving the clear displaying with the 7 segments in the predetermined background color.

The light emitting element disposed at the side surface of the light guiding plate includes red, green and blue light emitting elements in such a manner as to independently turn on or off the red, green and blue light emitting elements. Consequently, the background color can be changed to a desired color only by turning on or off switches for the red, green and blue light emitting elements, and further, the desired background color can be obtained in substantially full colors by mixing the colors.

A light emitting display device in another preferred embodiment according to the present invention comprises: a light guiding plate having an uneven portion formed in conformity with a pattern of a desired display image at a reverse surface thereof; and a light emitting element disposed at a side surface of the light guiding plate in such a manner as to introduce a light into the light guiding plate.

With the above-described structure, the light introduced into the light guiding plate is reflected as the uneven portion is, thereby forming the display image without forming a display panel having a colorfully formed display image. That is to say, the unevenness is formed at a portion in conformity with the shape of the display image at the reverse side of the light guiding plate, and further, the light introduced into the light guiding plate is turbulently reflected on the uneven portion so as to be lighted at the obverse of the light guiding plate, so that the light looks like being emitted at the uneven portion. In other words, the light introduced into the light guiding plate is observed to be emitted directly at the portion at which the unevenness is formed. As a consequence, unlike in the case where the light introduced into the light guiding plate applys to another display panel up by indirect use, the light introduced into the light guiding plate can be effectively utilized, thereby achieving bright displaying with a small input.

A plurality of the light guiding plates having the light emitting element at the side surface are laminated with an interval, thus displaying the patterns of the display images formed on at least two light guiding plates in superimposition.

Consequently, the stereoscopic displaying can be achieved with the simple configuration. Additionally, the background having only the surroundings blurred may be obtained by using, for example, another light guiding plate, thereby providing a very fresh light emitting display device. Here, the term "with an interval" signifies that an interval is formed between the adjacent light guiding plates in such a manner as not to mix the light emitted from the light emitting element of one light guiding plate to another adjacent light guiding plate in an extent not to occurance a trouble. To the contrary, if the display images can be superimposed without any dispersion of the mutual display images owing to an arrangement space, the light guiding plates may be largely separated from each other.

DETAILED DESCRIPTION

Figure 1A:
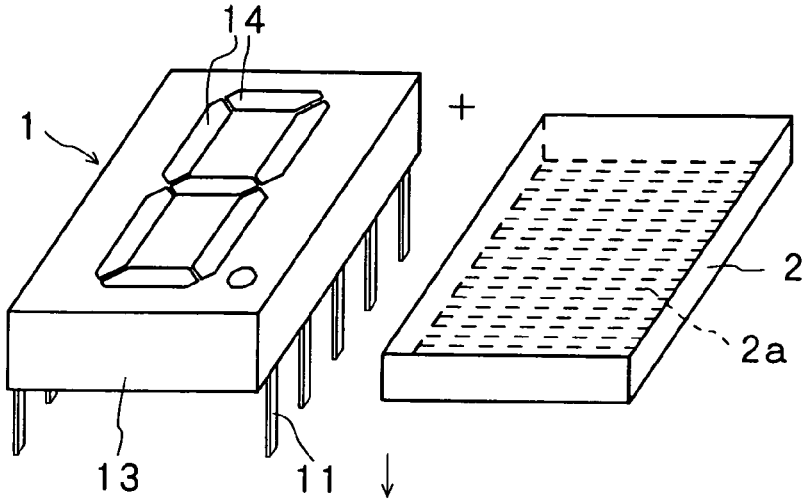
FIGS. 1A to 1C are explanatory views of a light emitting display device in a preferred embodiment according to the present invention.
Figure 1B:
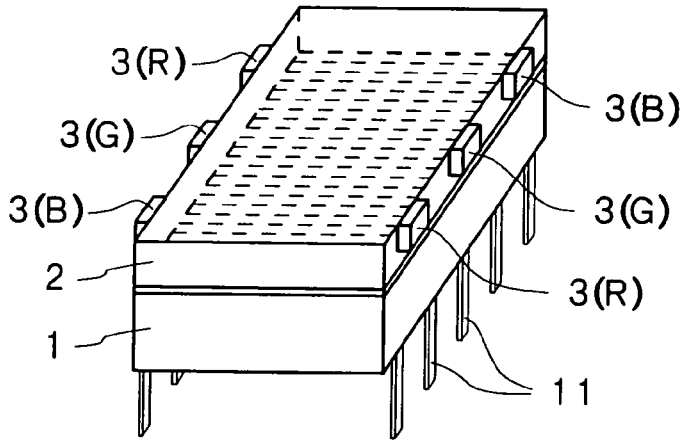
Figure 1C:
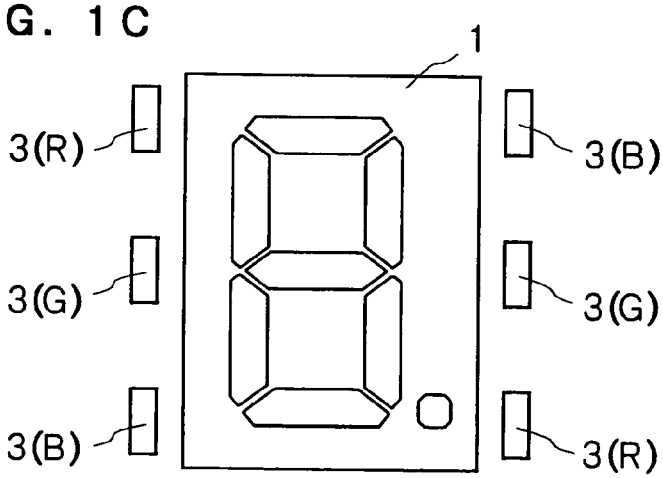

A description will be given below of a light emitting display device in a first preferred embodiment according to the present invention in reference to the attached drawings. FIG. 1A is an explanatory view of details of the light emitting display device according to the present invention; FIG. 1B is a perspective explanatory view of an assembled state; and FIG. 1C is a plan view explanatory of a state in which only a light guiding plate is removed. As shown in FIGS. 1A to 1C, a light guiding plate 2 is provided (superimposed) on the obverse side of a display 1 for displaying a display image while varying the display image. An uneven portion 2*a* is formed at a predetermined position at the reverse surface of the light guiding plate 2. Light emitting elements 3 are attached to the side surfaces of the light guiding plate 2 in such a manner as to introduce (enter) a light into the light guiding plate 2.

Although it is much preferable that a numeral display using a 7-segment LED, for example, should be used as the display 1 since the luminance at a display portion is great and the display luminance cannot be degraded in spite of superimposition on the light guiding plate, the display device according to the present invention is not limited to the 7-segment display, and therefore, it may include a display for displaying a letter, a liquid crystal display or a dot matrix display using LEDs. In fact, the display device according to the present invention can be applied to a display in which it is required that surroundings (i.e., background) look gorgeous.

Figure 6A:
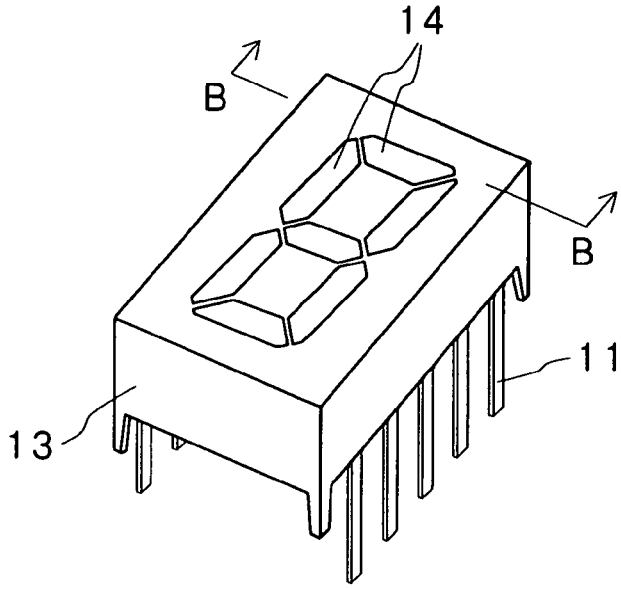
FIG. 6A PRIOR ART
FIGS. 6A and 6B are explanatory views of one example of a conventional 7-segment display.
Figure 6B:
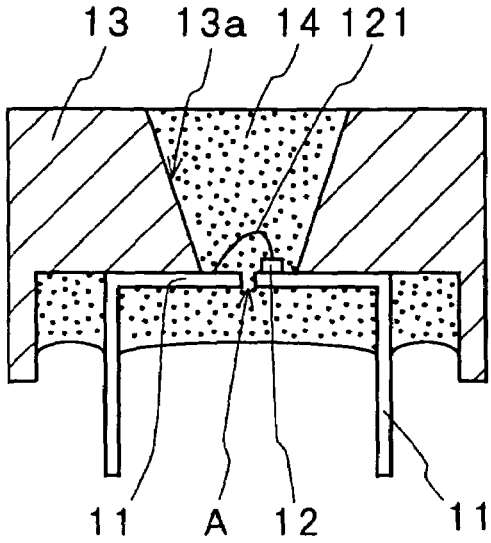
FIG. 6B PRIOR ART
Figure 7:
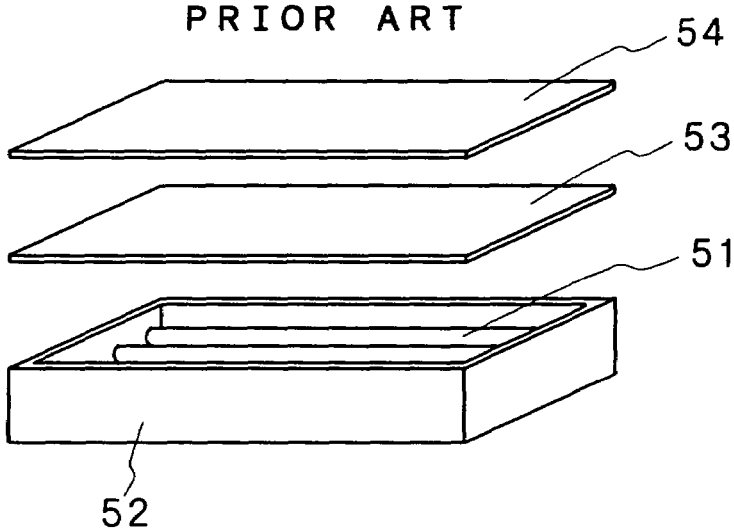
FIG. 7 PRIOR ART
FIG. 7 is an explanatory view of one example of a conventional illumination signboard.
Figure 8:
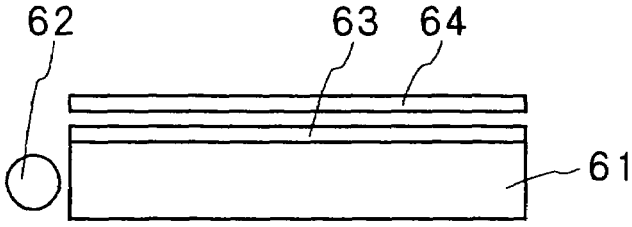
FIG. 8 PRIOR ART
FIG. 8 is a view illustrating the configuration of a backlight for use in the conventional illumination signboard or a conventional liquid crystal display device.

The display 1 in the embodiment shown in FIGS. 1A to 1C is a numeral display of 7 segments in the same configuration as that shown in FIGS. 6A and 6B, as described above. Specifically, LED chips for each of the 7 segments are bonded onto a lead 11 formed by a lead frame; one electrode of the LED chip is connected to another lead 11 via a wire such as a gold wire; the segments are covered with a reflecting case 13, thus to be optically separated from other segments; and a transparent resin 14 is filled into a light guiding portion constituting each of the segments in the reflecting case.

The reflecting case 13 is made of a plastic injection molded product such as a white high heat resistant super engineering plastics (for example, a liquid crystal polymer). Although an obverse surface of a display face side of a conventional reflecting case is painted in black, it is preferable that the obverse surface of the display for use in the light emitting display device according to the present invention should not be subjected to such painting or should be formed in inconspicuous pale color. This is to prevent any mixture of a color of lighting from the light guiding plate 2, described later.

Figure 3:
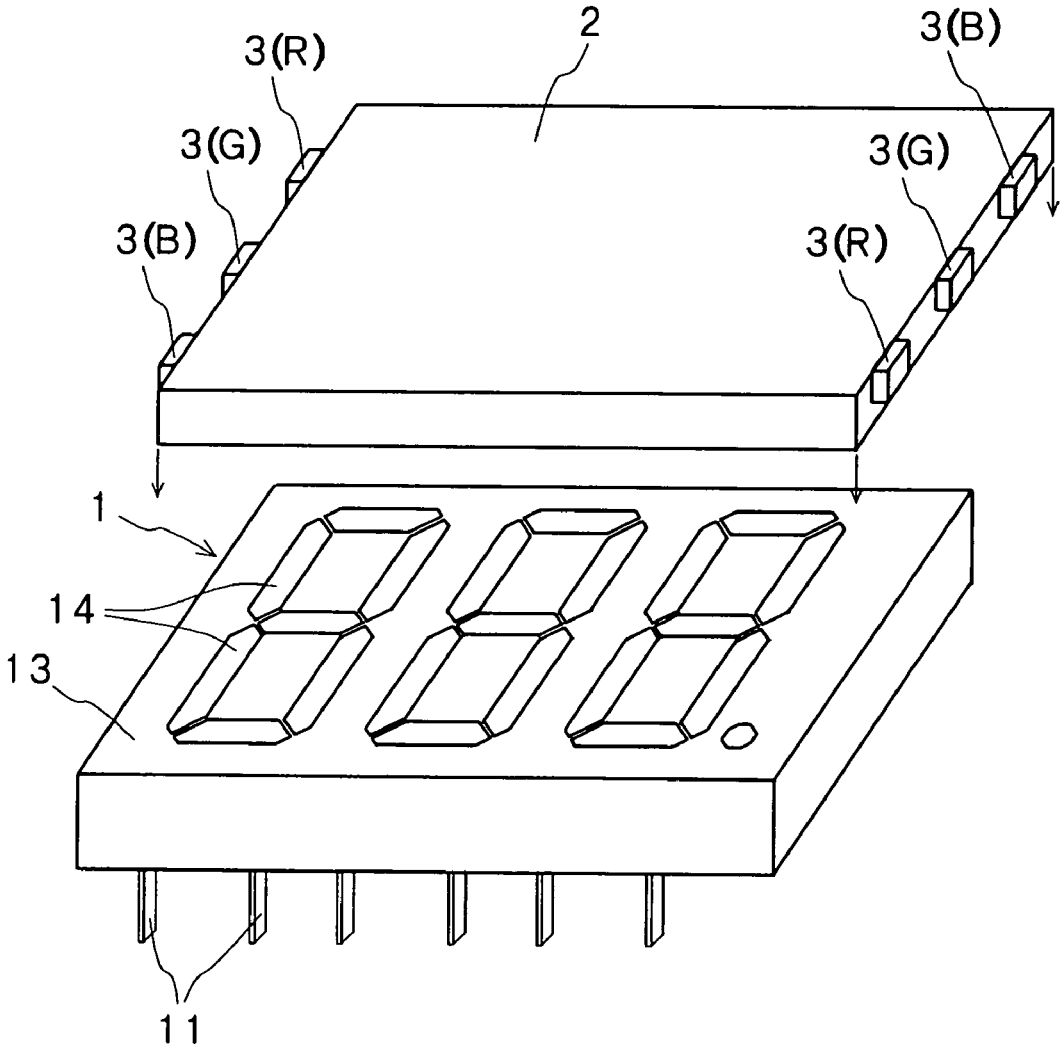
FIG. 3 is an explanatory view of a light emitting display device in another preferred embodiment according to the present invention.

The numeral display of only one digit is shown in FIGS. 1A to 1C. However, like a numeral display of three digits shown in FIG. 3, a numeral of two or more digits may be formed in one case. Alternatively, a plurality of numeral displays of one digit may be arranged in a lateral direction, thereby obtaining a numeral display of several digits. Otherwise, several numeral displays may be arranged in a vertical direction. In such a case, the light guiding plate 2, which is described later, may be formed in such a manner as to cover the entire display 1, and therefore, the connecting portions of a plurality of elements can be concealed even if the display 1 consists of the plurality of elements.

A light guiding plate serving as a backlight for a normal liquid crystal display device is used as the light guiding plate 2, which is adapted to appropriately reflect light introduced from a side surface thereof so as to take out the light in a predetermined direction. Specifically, the light guiding plate 2 is made of, for example, polycarbonate or an acrylic resin (PMMA), is formed in a thickness of about 0.8 mm to about 25 mm, and has the uneven portion 2*a* at the reverse (i.e., a reverse surface to the obverse) in a region from which the light is intended to be emitted. The region from which the light is intended to be emitted is formed at a portion other than each of the segments in the case of, for example, the above-described 7-segment display. However, in the case where the luminance of the display image on the display 1 is great, like the 7 segments made of the LEDs, and therefore, cannot be cancelled by the light radiated from the light guiding plate 2, the uneven portion 2*a* may be formed over the entire surface.

The unevenness is formed to make turbulently reflect the light, as described above, and it may be a groove formed in a parallel and linear manner (i.e., a hairline) or a grain having unevenness randomly formed like creases. The light introduced from the side surface is irradiated from the obverse after the turbulent reflection on the uneven portion 2*a* formed at the reverse while being repeated to be regularly reflected inside of the light guiding plate 2.

Figure 2:
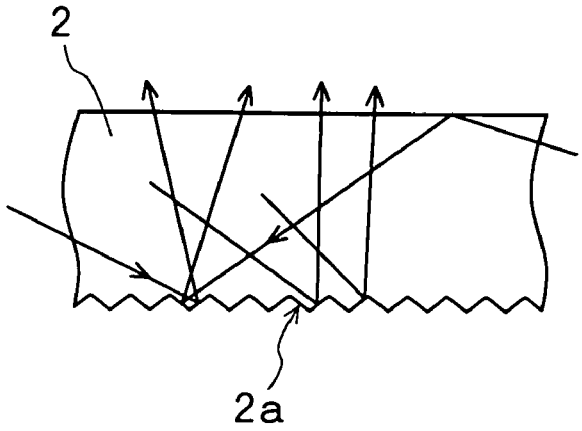
FIG. 2 is an explanatory view of the principle of lighting at an uneven portion formed on a light guiding plate in the light emitting display device according to the present invention.

In other words, like a path of the light incident into the light guiding plate 2 shown in FIG. 2, the light incident into the light guiding plate 2 is liable to be regularly reflected on the portion not having any unevenness, and travels while the regular reflection is repeated inside of the light guiding plate 2; in contrast, the incident angle of the light traveling toward the uneven portion 2*a* is varied at the uneven portion 2*a*, and a part of the light travels toward the upper surface of the light guiding plate 2, to be thus radiated from the light guiding plate 2.

The light which cannot be radiated is reflected on another uneven portion 2*a* to thus be radiated toward the obverse while being regularly reflected inside of the light guiding plate 2. Since the light goes out from the obverse after it is reflected on the uneven portion 2*a* is observed, the uneven portion 2*a* looks luminous. In this case, a light reflecting film is provided at the side surface of the light guiding plate 2, in which the light emitting element is not provided, so that the light leaking outside can be reduced, thus effectively utilizing the light.

That is to say, although a pattern of a reflecting film for adjusting a reflection quantity according to the light intensity may be formed at the reverse in a normal backlight in order to uniformly take out the light from the obverse, the light guiding plate 2 according to the present invention is configured such that a reflection pattern is not formed on the reverse and the light is taken out owing to the reflection on the uneven portion, so that the light incident to the reverse from outside (for example, the light emitted from the display 1) passes through the light guiding plate 2 as it is. Incidentally, it is preferable that a clearance between the light guiding plate 2 and the display 1 is formed, because a difference in index of refraction between the light guiding plate 2 and air become great, thereby facilitating the regular reflection inside of the light guiding plate 2 so as to reduce the light leaking from the light guiding plate 2.

Although the depth of the unevenness depends upon the quantity of the light emitted from the light emitting element 3 and the size of the light guiding plate 2, it may be such a height that the light is reflected to the upper surface on the uneven portion 2*a* while sufficiently repeating the regular reflection inside of the light guiding plate 2. In the hairline in the embodiment shown in FIGS. 1A to 1C, the light guiding plate 2 was 16 mm in length, 28 mm in width and 2 mm in thickness, and further, grooves, each having a depth of about 0.015 mm, were formed at intervals of about 0.02 mm.

The light emitting element 3 may be an LED chip by itself, a lamp type light emitting element coated with a domed resin, or a chip type light emitting element having an LED chip mounted on a chip-like insulating substrate and being coated with a resin. Alternatively, the light emitting element 3 is not an LED but an optical fiber connected to a light source. Otherwise, a light source such as a heat fluorescent tube or a cold-cathode tube may be used in the case of a large-sized display device.

It is preferable that the light emitting element 3 include light emitting elements of three primary colors, that is, red (R), green (G) and blue (B) so as to form the background in full colors. In the case of the LED, a red light emitting element may be fabricated by using an InGaAlP-based compound semiconductor; a green light emitting element may be fabricated by using a GaN-based compound semiconductor or a GaP-based compound semiconductor; and a blue light emitting element may be fabricated by using a GaN-based compound semiconductor. Consequently, light emission of high luminance can be achieved with a chip as small as 0.22 mm to 0.26 mm×0.22 mm to 0.26 mm. As shown in FIGS. 1B and 1C, the light emitting elements of the colors were respectively disposed on the right and left sides of the light guiding plate 2 having such a size as described in the above embodiment, thereby satisfactorily displaying the background color.

As shown in FIGS. 1B and 1C, the arrangement of the light emitting elements 3(R), 3(G) and 3(B) of the respective colors in a crossing manner is preferable since the light is liable to be readily diffused inside of the light guiding plate 2. In other words, if the light is made to enter from the center at one side surface of the light guiding plate 2, the light is relatively liable to be diffused inside of the entire light guiding plate. However, in the case where the light is made to enter from an end, the light is insufficiently diffused to the opposite end. Therefore, the counterpart light emitting elements of the same color are arranged at the opposite other ends, thereby facilitating the diffusion of the lights of all of the colors inside of the entire light guiding plate 2.

Moreover, a drive circuit is provided for independently turning on or off the light emitting elements 3 of R, G and B, so that the background color can be controlled by turning on only the light emitting element of a desired color, and further, the light of an intermediate color can be emitted by mixing the lights of two or three colors. Additionally, the background color can be achieved in a desired substantially full color by varying a drive current of each of the light emitting elements, adjusting the luminance and mixing the lights of the colors. In this manner, the background color can be readily controlled by using the LED as the light emitting element.

The light emitting element 3 may be attached directly to the side surface of the light guiding plate 2, as shown in FIG. 1B, or may be disposed in the light guiding plate 2 with a clearance, as shown in FIG. 1C. The light emitting element 3 needs to be provided in such a manner that the light can enter into the light guiding plate 2 and can be readily diffused there according to the orientation characteristics of the light emitting element. Otherwise, a recess may be formed at a part of the side wall of the light guiding plate, and then, the light emitting element may be put into the recess, although not shown.

Alternatively, the surroundings of the light emitting element 3 may be covered with a reflecting film or the like in order to prevent much leakage of the light, which is not incident into the light guiding plate 2, although not shown, so that it is desirable that most of the light emitted from the light emitting element 3 should be made to enter into the light guiding plate 2. Moreover, the side walls, onto which the light emitting elements 3 are provided, are not limited to the both side walls in the light guiding plate, and therefore, the light emitting elements 3 may be provided onto all of the side walls or only one side wall. The manner is determined according to a required intensity of the emitted light.

Additionally, in the case where the light emission is not uniform inside of the light guiding plate, a light diffusing plate made of polycarbonate or the like may be further provided on the obverse, although not shown, thereby achieving the uniform light radiation from the light guiding plate.

The light emitting display device according to the present invention is provided with the light guiding plate 2 having the unevenness at a desired portion of the reverse on the display, for example, of the 7 segments or the like, so as to allow the light of a desired color to enter from the side surface of the light guiding plate 2. Consequently, the background of the portion other than the display portion can be lighted in the desired color simply by only additionally providing a light guiding plate and a few light emitting elements. That is to say, the light guiding plate is a transparent plate for propagating the light, and further, the light of the display image emitted from the display is irradiated in a direction substantially perpendicular to the display face. Therefore, the light from the display passes through the light guiding plate, so that the display image on the display can be observed from the obverse of the light guiding plate as it is.

In the meantime, the light of a desired color is incident into the light guiding plate through the side surface thereof from the light emitting element. Since a difference in index of refraction between the light guiding plate and the ambient air is large, a part of the light is reflected toward the upper surface owing to the unevenness formed at the reverse of the light guiding plate while the regular reflection is repeated inside of the light guiding plate, and thus, it is radiated outward. As a consequence, the background of the portion other than the display image on the display is lighted in the desired color by forming the above-described unevenness at the portion other than the display image on the display (for example, the portion other than the segments in the 7-segment display). Here, as described above, in the case where the display is the 7 segments using the LEDs, there arises no problem if the unevenness is formed over the entire reverse of the light guiding plate.

In the above-described preferred embodiment, one light guiding plate is provided on the display. However, two or more light guiding plates may be provided, wherein different patterns, for example, unevenness in conformity of the picture of Mt. Fuji may be formed at the reverse, so that the picture and the image on the display can be displayed in superimposition.

Incidentally, since the light emitting elements disposed on the two or more light guiding plates need to be turned on in the case where the different patterns are formed on the light guiding plates each other and displayed in superimposition, each of the light emitting elements should be covered with the reflecting film in such a manner as to prevent any leakage of the light from each of the light emitting elements mixture the colors between the different light guiding plates, and further, the light guiding plates should be separated from each other in order to prevent the lights from traveling in the light guiding plates. Normally, when the clearance is formed between the light guiding plates, the regular reflection can be readily achieved since the index of refraction of the air is small, and further, the light is easily reflected toward the upper surface owing to the unevenness formed at the reverse of the light guiding plate, thus preventing the mixture of the colors of the lights.

According to the present invention, the background of the display image on the display of the 7 segments or the like can be lighted in the desired color with the very inexpensive configuration. As a result, also in the case where a display in a play machine or the like should be made gorgeous and vivid, the use of the light emitting display device according to the present invention enables the background to be gorgeously displayed while a desired image is clearly displayed, thereby arousing the interest in playing a game. Moreover, even in the case where a display image is displayed together with a simple background, a composite image can be displayed with the very inexpensive configuration according to the present invention.

Figure 4A:
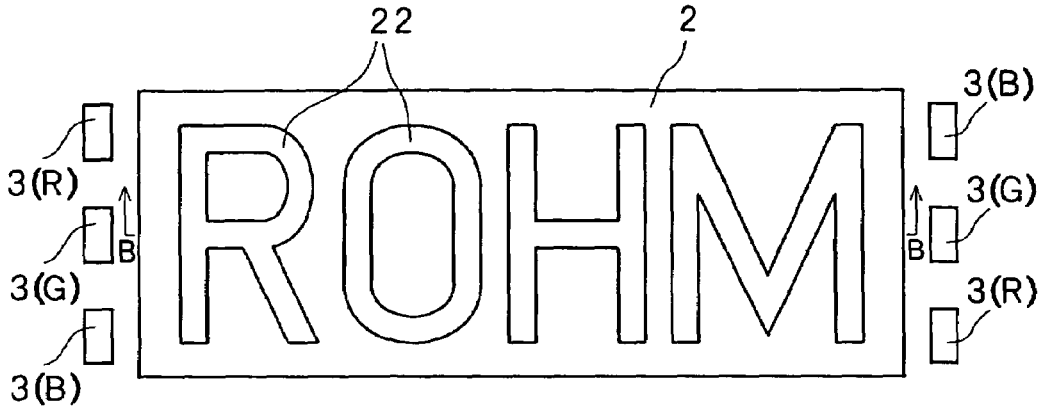
FIGS. 4A to 4C are explanatory views of a light emitting display device in a further preferred embodiment according to the present invention.
Figure 4B:
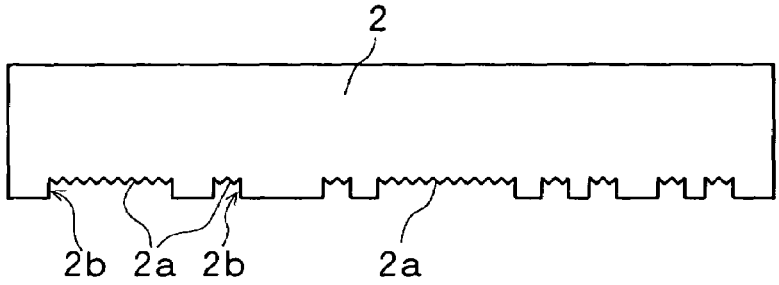
Figure 4C:
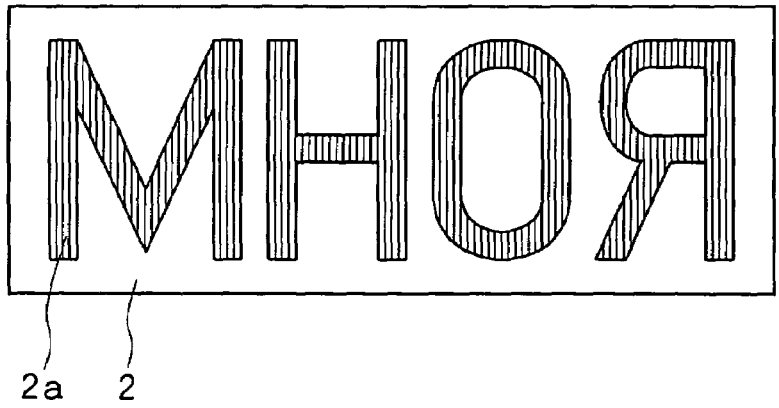

Next, a description will be given of a light emitting display device in a second preferred embodiment according to the present invention in reference to the attached drawings. FIG. 4A is a plan view explanatory of the light emitting display device in the second preferred embodiment; FIG. 4B is a cross-sectional view taken along a line B-B of FIG. 4A; and FIG. 4C is a back view. As shown in FIGS. 4A to 4C, an uneven portion 2*a* is formed at the reverse of a light guiding plate 2 in conformity with the shape of a desired display image 22, and further, light emitting elements 3 are attached to the side surface of the light guiding plate 2 in such a manner as to introduce light into the light guiding plate 2.

Although in the embodiment shown in FIGS. 4A to 4C, the display image 22 is an abbreviation of a company name used for a company's prospectus or advertisement, it is not limited to this. For example, the display image 22 may be a relatively simple image such as an image which displays constant contents all the time, including a guide lamp at an emergency exit for guiding a person in a building, a display lamp at an entrance or an exit in a public building or a figure for public relation or advertisement.

In the same manner as described above, the light guiding plate 2 is made of, for example, polycarbonate or an acrylic resin (PMMA), is formed in a thickness of about 0.8 mm to about 25 mm, and has the uneven portion 2*a* at the reverse (i.e., a reverse surface to the obverse) in a region from which the light is intended to be emitted. The region from which the light is intended to be emitted is formed at a portion corresponding to the above-described display image 1. For example, as shown in FIGS. 4B and 4C, in the case where the display image 22 is "ROHM", the uneven portion 2*a* is formed at the reverse of the light guiding plate 2 corresponding to the letters.

In the embodiment shown in FIGS. 4A to 4C, the portion per se having the uneven portion 2*a* formed thereat is formed in a recessed portion 2*b* deeper than the other reverse surface of the light guiding plate 2. The recessed portion 2*b* is formed in order to clarify the uneven portion 2*a* and facilitate turbulent reflection. Even without any recessed portion 2*b*, substantially the same effect can be produced as long as the uneven portion 2*a* is formed directly at the reverse of the light guiding plate 2.

The unevenness is formed and functions in the same manner as in the above-described description in reference to FIG. 2. That is to say, although a reflection pattern for adjusting a reflection quantity according to the light intensity may be formed at the reverse in a backlight used in a normal liquid crystal display device or an illumination signboard in order to uniformly take out the light from the obverse, the light guiding plate 2 according to the present invention is configured such that a reflection pattern is not formed at the reverse and the light is taken out owing to the reflection on the uneven portion. In the meantime, the light incident to the reverse from outside, for example, the under light guiding plate can pass through the light guiding plate 2 as it is. In this manner, as described above, two or more light guiding plates are superimposed with a predetermined clearance, so that images displayed by the plurality of light guiding plates can be superimposed one on another.

Although the depth of the unevenness depends upon the quantity of the light emitted from the light emitting element 3 and the size of the light guiding plate 2, it may be such a height that the light is reflected to the upper surface on the uneven portion 2*a* while sufficiently repeating the regular reflection inside of the light guiding plate 2. In the hairline in the embodiment shown in FIGS. 4A to 4C, the light guiding plate 2 was 22 mm in length, 80 mm in width and 2 mm in thickness, and further, grooves, each having a depth of about 0.015 mm, were formed at intervals of about 0.02 mm.

The light emitting element 3 also can be configured in the same manner as in the above-described preferred embodiment. Since in the present second embodiment, the light from the light emitting element is used directly as the display image, the using efficiency is high. Luminance can be satisfactorily obtained with an LED in the case of displaying in a normal guide board.

It is preferable that the light emitting element 3 include light emitting elements of three primary colors, that is, red (R), green (G) and blue (B) so as to achieve the displaying in substantially full colors. In the case of the LED, the same LED as described above can be used. As shown in FIG. 4A, the light emitting elements of the colors were respectively disposed on the right and left sides of the light guiding plate 2 having such a size as described in the above preferred embodiment, thereby satisfactorily displaying the image with the uneven portion 2*a* formed at the light guiding plate 2. In the case where the light guiding plate 2 is large, the image can be brightly displayed by providing numerous light emitting elements. It is preferable that the light emitting elements R, G and B should be arranged in a crossing manner such that the light is liable to be readily diffused in the same manner as in the above-described preferred embodiment.

Moreover, it is preferable that a drive circuit should be provided for independently turning on or off the light emitting elements 3 of R, G and B in the same manner as in the above-described preferred embodiment.

As shown in FIG. 4A, the light emitting element 3 may be slightly separated from the side surface of the light guiding plate 2 or may be attached directly to the light guiding plate 2. A recessed portion may be formed at a part of the side wall of the light guiding plate, and then, the light emitting element may be put into the recessed portion. The light emitting elements are arranged in the same manner as in the above-described embodiment. The same merit of the provision of a light diffusing plate made of polycarbonate or the like at the obverse is produced as in the above-described embodiment.

In the light emitting display device in the present second embodiment, the uneven portion in conformity with the shape of the image to be displayed is formed at the reverse of the light guiding plate, and further, the light emitting elements are arranged in such a manner as to allow the light to enter through the side wall of the light guiding plate, thereby lighting and displaying a simple figure or letter with the light of a desired color.

In other words, since a difference in index of refraction between the light guiding plate and the ambient air is large, the light incident through the side wall of the light guiding plate travels inside of the light guiding plate while the regular reflection is repeated inside of the light guiding plate. Since the light, which reaches the uneven portion formed at the reverse of the light guiding plate, is turbulently reflected on the uneven portion, it is not regularly reflected but is turbulently reflected toward the obverse. Consequently, only the portion at which the uneven portion is formed looks like lighting, that is, it is displayed as the image in the shape having the uneven portion formed thereat. As described above, the image can be displayed in the desired color by providing the light emitting elements of the three primary colors R, G and B.

Consequently, the efficiency of using the incident light is very high, so that the image can be brightly displayed with the small light. In the case where the displaying in one color is satisfied, such as the guide lamp of the emergency exit in the building, for example, the display device can be configured by simply attaching one normal LED as the light emitting element onto each of both sides, thereby remarkably saving the electric power. In addition, since the light emitting display device is very thin, it may be stuck onto a wall, because it is only the thickness of the light guiding plate without any need of a display panel, a light source and a casing for holding a display panel or a light source.

Figure 5:
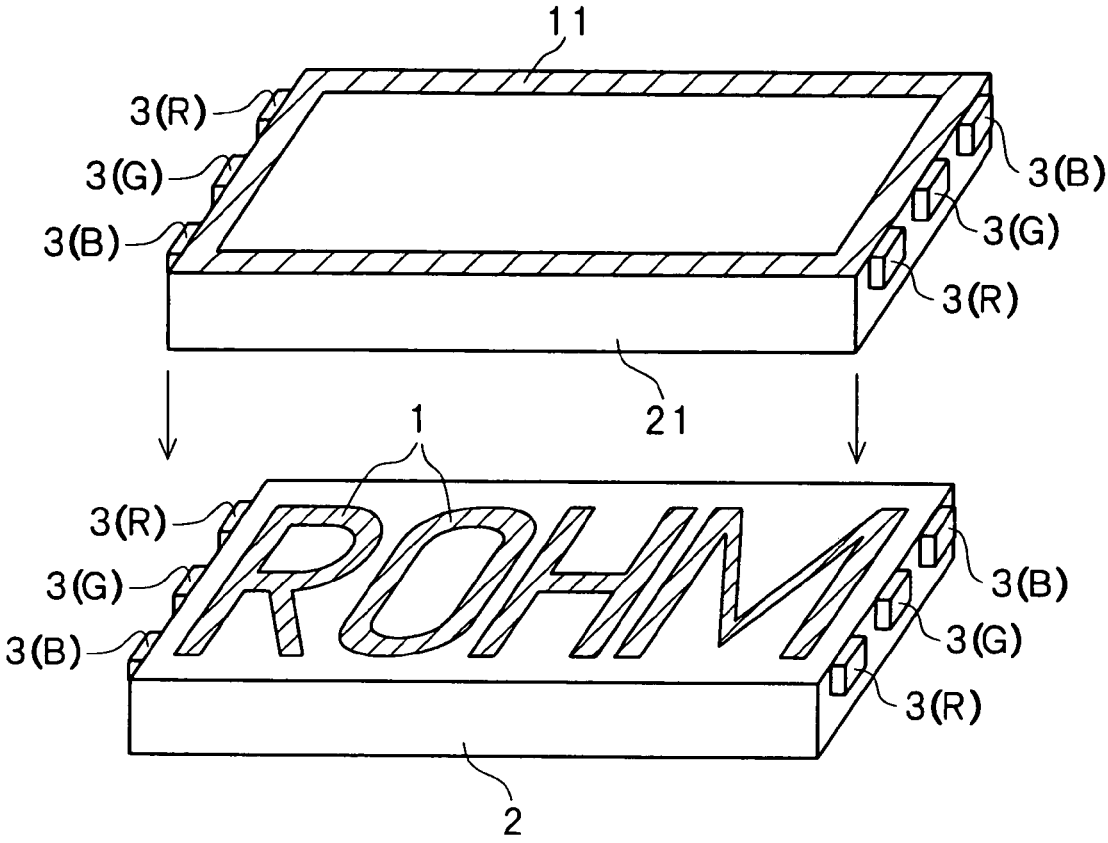
FIG. 5 is an explanatory view of a light emitting display device in a still further preferred embodiment according to the present invention.

The light emitting display device is constituted of one light guiding plate and the light emitting elements for emitting the light to the light guiding plate in the above-described embodiment. However, since the light incident in the direction perpendicular to the light guiding plate passes through the light guiding plate, a composite image may be formed if two or more light guiding plates are superimposed, as shown in FIG. 5. Specifically, an uneven portion corresponding to an image similar to an image shown in FIG. 4 is formed at a first light guiding plate 2; in contrast, an uneven portion corresponding to a frame-like image 11 to be formed only at a margin is formed at a second light guiding plate 21. An image, on which patterns in different emitted light colors are superimposed, can be displayed by making a color of light introduced into the first light guiding plate 2 different from a color of light introduced into the second light guiding plate 21 and by blurring the light incident into the second light guiding plate 21 in a low light intensity.

The images formed on the plurality of light guiding plates need not be formed at portions at which the images are not superimposed. For example, a light guiding plate which image corresponds to only some regions and another guiding plate which image corresponds to the entire surface, for example, a picture such as Mt. Fuji can be superimposed. As described above, also in the case where the images formed on the upper and lower light guiding plates are superimposed, the light radiated from the lower light guiding plate looks like passing through the upper light guiding plate, and further, the upper light guiding plate radiates the light in a shape in conformity with the image formed thereon in accordance with the same theory as described above, thus displaying the image in superimposition, although the colors of the lights radiated from the upper and lower light guiding plates are mixed together.

In the same manner, the light emitting display device may be constituted of three or more light guiding plates in lamination. Here, in the case where different patterns are formed on the light guiding plates and are displayed in superimposition, the light emitting display device should be configured in order to prevent any leakage of the light in the same manner as in the above-described preferred embodiment.

In the present preferred embodiment, a simple display image for the advertisement or an emergency exit, an entrance or an exit in a building or the like can be simply displayed by the very inexpensive device, and further, the light can be very effectively used. As a consequence, the light emitting element can be constituted of a semiconductor element such as the LED, thus providing the inexpensive light emitting display device with the very low power consumption. Furthermore, the display image can also be varied by periodically varying the color of the light, thus achieving the display device with accentuation.

Although preferred examples have been described in some detail it is to be understood that certain changes can be made by those skilled in the art without departing from the spirit and scope of the invention as defined by the appended claims.

What is claimed is:

1. A light emitting display device comprising:

a display for displaying a display image while varying the display image, the display having a light source therein;

a light guiding plate provided on or over a displaying surface of the display, the light guiding plate having unevenness at a predetermined position at a surface that faces the display; and a light emitting element disposed at a side surface of the light guiding plate in such a manner as to introduce a light into the light guiding plate.

2. The light emitting display device according to claim 1, wherein the display is any one of a display using 7 segments, a display for displaying a letter or a figure, a liquid crystal display, and a dot matrix display using LED.

3. The light emitting display device according to claim 1, wherein the display is a display using 7 segments having LEDs, and the unevenness is formed over the entire surface of the light guiding plate or over a portion of the surface that does not cover the 7 segments of the display.

4. The light emitting display device according to claim 1, wherein the unevenness is formed by hairlining or graining.

5. The light emitting display device according to claim 1, wherein a clearance is defined between the light guiding plate and the display.

6. The light emitting display device according to claim 1, wherein the light emitting element is any one of an LED chip, a lamp type LED coated with a domed resin, a chip type LED having an LED chip mounted on a chip-like insulating substrate and coated with a resin, and an optical fiber connected to a light source.

7. The light emitting display device according to claim 1, wherein the light emitting element disposed at the side surface of the light guiding plate includes red, green and blue light emitting elements in such a manner as to independently turn on or off the red, green and blue light emitting elements.

8. The light emitting display device according to claim 1, wherein the light emitting element is disposed at the side surface of the light guiding plate directly or with an interval.

9. The light emitting display device according to claim 1, wherein a surrounding of the light emitting element is covered with a reflecting film in such a manner that the light emitted from the light emitting element readily enters into the light guiding plate.

10. The light emitting display device according to claim 1, wherein a light diffusing plate is disposed on another surface of the light guiding plate opposite to said surface with the unevenness.

11. The light emitting display device according to claim 1, wherein a plurality of the light guiding plates are disposed on or over the displaying surface.

12. The light emitting display device according to claim 1, wherein the light emitting element disposed at the side surface of the light guiding plate includes red, green and blue light emitting elements, and on a first side surface of the light guiding plate, red, green and blue light emitting elements are arranged in this order, and on a second side surface opposite to the first side surface, blue, green and red light emitting elements are arranged in this order.

13. The light emitting display device according to claim 1, wherein the unevenness of the light guiding plate reflects the light from the light emitting element in such a manner that the light guiding plate displays a background image for the display image.

14. The light emitting display device according to claim 1, wherein the displaying surface of the display is a top surface of the display and the surface of the light guiding plate that faces the display is a bottom surface of the light guiding plate.

15. The light emitting display device according to claim 14, wherein a light diffusing plate is disposed on a top surface of the light guiding plate opposite to the bottom surface.

16. The light emitting display device according to claim 14, wherein a plurality of the light guiding plates are disposed on or over the top surface of the display.

17. The light emitting display device according to claim 1, wherein:

the display includes a top side and a bottom side;

the light guiding plate covers the top side of the display, and includes a bottom surface facing the top side of the display and a top surface opposite to the bottom surface; and the unevenness is formed at the bottom surface of the light guiding plate.

* * * * *